US006622000B2

(12) United States Patent
Furukawa et al.

(10) Patent No.: US 6,622,000 B2
(45) Date of Patent: Sep. 16, 2003

(54) DEVELOPING APPARATUS HAVING A CHARGE AMOUNT CONTROL MEMBER

(75) Inventors: Kazuhiko Furukawa, Tenri (JP); Hiroyuki Hirakawa, Tenri (JP); Shigeru Nishio, Tenri (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/916,066

(22) Filed: Jul. 26, 2001

(65) Prior Publication Data

US 2002/0012552 A1 Jan. 31, 2002

(30) Foreign Application Priority Data

Jul. 28, 2000 (JP) ..... 2000-229859
Jul. 19, 2001 (JP) ..... 2001-219882

(51) Int. Cl.[7] ..... G03G 15/08
(52) U.S. Cl. ..... 399/281; 399/284
(58) Field of Search ..... 399/279, 281, 399/284, 285

(56) References Cited

U.S. PATENT DOCUMENTS 4,100,884 A * 7/1978 Mochizuki et al. ..... 399/274
4,445,771 A * 5/1984 Sakamoto et al. ..... 399/276
4,450,220 A * 5/1984 Haneda et al. ..... 361/226
5,416,567 A * 5/1995 Toyoshima et al. ..... 399/254
5,887,233 A * 3/1999 Abe et al. ..... 250/326
5,923,932 A * 7/1999 Williams ..... 399/266
6,223,013 B1 * 4/2001 Eklund et al. ..... 399/266
6,275,666 B1 * 8/2001 Furukawa et al. ..... 399/55

FOREIGN PATENT DOCUMENTS

JP 54092250 A * 7/1979 ..... G03G/15/09
JP 56014269 A * 2/1981 ..... G03G/15/09
JP 56027158 A * 3/1981 ..... G03G/13/08
JP 62211674 A * 9/1987 ..... G03G/15/08
JP 10-63096 3/1998
JP 10-148999 6/1998

* cited by examiner

*Primary Examiner*—Robert Beatty
(74) *Attorney, Agent, or Firm*—Edwards & Angell, LLP; David C. Conlin; David A. Tucker

(57) ABSTRACT

A developing apparatus includes a developer carrier carrying a developer on its surface, a developer regulating member regulating layer thickness of the developer, a charge amount control member controlling the charge amount of the developer and a charge supplying apparatus downstream of the charge amount control member. The charge amount control member controls the amount of charges of the developer, by causing the developer fly over the developer carrier, using an AC voltage applied between the developer carrier and the charge amount control member, and by applying the electric charges generated by gas electrolytic dissociation caused by the AC voltage. By this structure, a developing apparatus can be provided which can improve stability of development and image quality, without necessitating delicate arrangement of the component materials of the developer.

12 Claims, 6 Drawing Sheets

WHEN TONER FLIES

WHEN TONER DOES NOT FLY

DEVELOPING APPARATUS HAVING A CHARGE AMOUNT CONTROL MEMBER

BACKGROUND OF THE INVENTION

1. Field of the Invention

The present invention relates to a developing apparatus used for an image forming apparatus such as a copying machine, a printer or the like, and, more specifically, to a developing apparatus and image forming apparatus in which electric charges generated by gas electrolytic dissociation are used for charging a developer.

2. Description of the Background Art

A structure of a developing apparatus used for a conventional image forming apparatus in accordance with electrophotography will be described with reference to FIG. 10. FIG. 10 shows a schematic structure of a developing apparatus applied to mono component developing method using a mono component developer consisting of toner only, in a conventional electrophotographic image forming apparatus.

Opposing to a photoreceptor drum 1 as an image carrier, a developing apparatus 4 for visualizing a latent electrostatic image formed on a surface of photoreceptor drum 1 is arranged. Developing apparatus 4 generally has a rotatable developing roller 41 provided opposing to a developer tank 40, and especially to an opening thereof, which tank contains a toner 10 which is an insulative developer. Developing roller 41 is arranged such that a portion thereof is exposed through the opening of developer tank 40 to be in contact, for example, with photoreceptor drum 1. This contact area serves as the developing area.

Mono component toner 10 is supplied by a supply roller 42 and absorbed by the surface of developing roller 41. In order to regulate the amount of toner absorbed by developing roller 41, a regulating member 43 is provided, in pressure-contact with the surface of developing roller 41. The toner absorbed by developing roller 41 has its amount regulated to a constant value, as it passes through the pressure-contact portion of regulating member 43. As it passes through the pressure-contact portion of regulating member 43, toner 10 absorbed by developing roller 41 is charged, by the friction with the regulating member 43.

Thereafter, toner 10 is conveyed to the developing area opposing to photoreceptor drum 1, while it is carried on the surface of developing roller 41. Toner 10 is then selectively adhered to photoreceptor drum 1 and developed, corresponding to the latent electrostatic image formed on the surface of photoreceptor drum 1.

After development, toner 10 that has not been used for development is conveyed to developer tank 40. In developer tank 40, a supply roller 42 is provided, in pressure-contact with developing roller 41, in order to remove and recover the toner 10 which was not used for development, from the surface of developing roller 41. Toner 10 that was not used for development and carried on the surface of developing roller 41 is scraped off by supply roller 42. Further, by supply roller 42, toner 10 is newly supplied to the surface of developing roller 41.

In order to ensure satisfactory development, generally, a developing bias voltage is supplied to developing roller 41. The developing bias voltage is set to such a voltage value that ensures adhesion of toner 10 on the latent electrostatic image at the time of development while toner 10 is not adhered to portions other than the latent electrostatic image on photoreceptor drum 1.

In order to apply a prescribed amount of electric charges of a prescribed polarity to the toner 10 absorbed by developing roller 41, a regulating voltage is supplied from regulating member 43. Therefore, as toner 10 passes through the pressure-contact portion of regulating member 43, the amount of the toner is made constant, the toner is friction-charged, and the toner thus charged by a prescribed amount with a prescribed polarity is conveyed to the developing area.

As described above, the mono-component toner as the developer is absorbed by the developing roller and conveyed to the developing area, and the toner is adhered to the latent electrostatic image on the photoreceptor drum, whereby an image is formed.

In the developing apparatus 4 to which the method of friction charging described above is applied, the charge amount of the toner charged by the regulating member 43 does not obtain to a sufficiently saturated state, and therefore, charge amount varies among toner particles. Further, there arc uncharged toner particles resulting from mis-contact with the regulating member 43, as well as toner particles charged to a polarity opposite to the desired polarity (hereinafter referred to as reverse-charged toner) that are inevitable in friction charging.

As a result, the developer comes to have wide distribution of charge amount, degrading stability of development. Particularly, it follows that the reverse-charged toner develops a portion which is inherently a non-image portion, and hence quality of the image is degraded. Further, an average value of charge amount significantly differs dependent on the material of the regulating member, toner material, toner particle diameter and the environment of use.

Therefore, in order to attain a desired average value of the charge amount and a desired charge polarity, it has been necessary to arrange delicately the materials to be added to the toner. Methods for improving such a problem include a developing apparatus disclosed in Japanese Patent Laying-Open No. 10-63096 (hereinafter referred to as a first prior art example) and a developing apparatus disclosed in Japanese Patent Laying-Open No. 10-148999, in which among electric charges generated by discharge, those having a desired polarity are extracted from an electric charge generating apparatus and applied to the toner (hereinafter, this method will be referred to as electric charge supplying method).

The developing apparatus disclosed in the first prior art example will be described with reference to FIG. 11. FIG. 11 is a schematic diagram representing a structure of the developing apparatus disclosed in the first prior art example. A developing apparatus 80 is provided at a position opposing to a photoreceptor drum 91 as an image carrier. In a housing 90 of developing apparatus 80, there are a developer carrier 92 opposing to and close to photoreceptor drum 91 and conveying toner adhered on its surface, a layer forming member 93 regulating the toner on developer carrier 92 to form a toner layer, a stirring supply member 94 stirring the toner and supplying the toner to developer carrier 92, an electric charge supplying member 95 arrange opposing to developer carrier 92 and generating discharge at the opposing position, and a charge control member 96 arranged between electric charge supplying member 95 and developer carrier 92 to limit an electrolytic dissociation area of discharge generated therebetween.

Developer carrier 92 mentioned above is rotatably supported, and to which a DC voltage of about −200V and having the same polarity as the toner is applied. Thus, an electric field is formed between developer carrier 92 and photoreceptor drum 91, and the toner is transferred onto the latent image on photoreceptor drum 91. By the above-described method, the average value of the charge amount can be controlled in a relatively simple manner, and the distribution of the charge amount can be made sharper to some extent. Further, in the developing apparatus 80, discharge is generated in a small space formed by developer carrier 92 having a surface rubber layer with volume resistivity of $10^6$ Ω·cm and layer forming member 93 formed of silicone rubber having volume resistivity of about $10^4$ to $10^{10}$ Ω·cm. At this time, the charge amount in the toner layer on developer carrier 92 is reduced by the electric charges of both polarities generated, and thereafter, the toner layer is charged to a desired charge amount, by electric charge supplying member 95. Consequently, variation in the charge amount between the toner once charged by the electric charge supplying member 95, rotated once while not used for development of a latent image on photoreceptor drum 91 and charged again, and the toner used for development of the latent image on photoreceptor drum 91, supplied newly on the developer carrier 92 and charged once, can be reduced, and hence uniform charging not dependent on history becomes possible.

As the condition of discharging to reduce the charge amount in the toner layer, a frequency within such a range in that the toner cannot reciprocate following the oscillating electric field in the space, for example, a frequency of 3 kHz is recommended, which prevents adhesion of toner to the layer forming member 93.

As to the voltage, DC offset of 0V, a voltage at least twice the discharge starting voltage in the small space (for example, 1200V), and not higher than the voltage causing leakage because of high voltage (for example, at most 3000V) is recommended, so that electric charges of both polarities exist uniformly in the small space.

Further, a proposal of a structure of electric charge supplying member 95 for suppressing generation of reverse-charged toner is also described.

In the conventional method of friction charging, the charge amount of the toner is in proportion to the power of 1.5 to 2.5 of the diameter of particles, if the toner composition is comparable. Therefore, when the toner has small particle diameter, specific charge amount (charge amount/mass) becomes too large. For example, in the developing apparatus to which the friction charging method is applied shown in FIG. 10, when toner having average particle diameter of 9.5 μm is introduced, the specific charge amount measured at the developing position is 35 to 40 μc/g. When the toner having the same composition but average particle diameter of 5.5 μm is used, the specific charge amount measured at the developing position is 65 to 68 μc/g, and the toner has high specific charge amount. The toner having high specific charge amount causes a problem that density of a solid black image cannot be made sufficiently high. It is possible to attain a desired density by ensuring a potential difference for development in accordance with the specific charge amount. For this purpose, however, there would be considerable burden on the related processes and components, including setting of high charge potential of the photoreceptor drum.

Even in the electric charge supplying method, when the toner, especially the toner having small particle diameter is charged to an amount higher than the desired charge amount because of friction with the layer forming member 93 or the like in forming a toner layer on the developer carrier 92, it is impossible to adjust to the desired charge amount by the electric charge supplying apparatus. It may be possible to finely adjust the compositions of the toner and the layer forming member 93 such that the charge amount caused by the friction with the layer forming member 93 and the like to be the same or smaller than the desired amount and to supplement the shortage by the electric charge supplying apparatus. When the charge amount resulting from friction is to be reduced, however, it follows that the reverse-charged toner increases. Such a severe adjustment of the materials is against the desired object which is to be attained by the electric charge supplying method.

In this regard, by using the developing apparatus described in the first prior art example, by once reducing the charge amount of the toner layer and then newly charging again as described above, it is possible to generate a toner layer having a relatively small specific charge amount even when the toner particle diameter is small.

By such charge processes, it is possible to control the average value of the charge amount to a desired value in a relatively simple manner. Further, the distribution of charge amount can be made sharper to some extent, variation in the charge amount cycle by cycle can be reduced, and satisfactory image can be obtained.

The developing apparatus in accordance with the first prior art example, however, is still not free of the reverse-charged toner from the following reason. There is a friction between the toner and the layer forming member 93 or stirring supplying member 94, and in addition there is a friction between toner particles. Therefore, by the time the layer is formed, some parts of the toner surface are charged negative while others are charged positive. When the amount of electric charges of one toner particle is considered, some toner particles are charged to have the opposite polarity. When the toner layer that has 1) a normal charge polarity when viewed as a whole but containing toner particles partially charged to the polarity opposite to the normal charging polarity, and 2) reverse-charged toner particles, is charged by electric charge supplying member 95, the electric charges generated by corona discharge move along an electric line of force 120 as shown in FIG. 12 and adhere to the toner. At this time, when the reverse-charged portion of the toner is on a surface where adhesion of electric charges is possible (upper portion of the deposited toner particles), the electric charges of opposite polarity (in FIG. 12, positive polarity) are electrically eliminated, and charged to the normal polarity (in FIG. 12, negative polarity).

However, when the reverse-charged portion is on the surface where adhesion of electric charges is impossible (below deposited toner particles), the reverse polarity charges cannot be eliminated, even when electric charges of a single polarity are applied by corona discharge.

More specifically, it is possible for the toner facing the electric charge supplying member 95 to attain the desired charge amount, by applying the electric charges generated by the electric charge supplying apparatus. It is impossible, however, for the toner particles not on the surface, that is, the toner particles existing in the toner layer, to effectively receive the electric charges.

The electric charges generated by the corona discharge cannot reach that side of the toner particles even of the surface toner which are on the opposite side viewed from the electric charge supplying member 95. Therefore, the electric charges of reverse polarity of such a portion cannot be canceled. Thus, it is the case that the desired electric charges can be applied only to the surface portion.

The same applies to discharging by charge clearing at the small gap between the layer forming member 93 and the image carrier 92.

The phenomenon is studied intensively with respect to this problem, and the method and conditions for charging have been found that enable stable charging of toner having small particles and low specific charges, by eliminating reverse-charged toners and local reverse charging.

SUMMARY OF THE INVENTION

An object of the present invention is to provide a developing apparatus capable of making smaller a distribution range of charge amount, particularly capable of reducing reverse-charged toners without requiring delicate arrangement of component materials of the developer, and improving stability of development and image quality by forming a toner layer of small particle size and low specific charges.

The above described objects can be attained by a developing apparatus in accordance with one aspect of the present invention, that is, a developing apparatus supplying a developer to an image carrier, including a developer carrier carrying a developer on its surface, a developer regulating member regulating layer thickness of the developer, and a charge amount control member controlling the charge amount of the developer, wherein the charge amount control member is provided downstream in the direction of movement of the developer than the layer thickness regulating member regulating the layer thickness of the developer and electrically insulated from the developer carrier, and by causing flight of the developer over the developer carrier, by an AC voltage applied between the developer carrier and the charge amount control member, electric charges generated by electrolytic dissociation of the gas caused by the AC voltage are applied to control the amount of electric charges of the developer.

In this structure, the developer carrier carrying the developer on its surface and the developer regulating member regulating the layer thickness of the developer carried by the developer carrier are electrically insulated, and by the AC voltage applied therebetween, the developer is caused to fly in the small space formed near the contact portion from the developer carrier, so that the electric charges generated by gas electrolytic dissociation caused by the AC voltage are applied and the charge amount of the developer is thus controlled.

Therefore, the developer flies in the small space where electric charges have been generated by gas electrolytic dissociation caused by the AC voltage, whereby the developer reciprocates in the small space where the electric charges generated by the gas electrolytic dissociation exist. As a result, such a control becomes possible in the that the whole developer comes to have uniform charge amount by the positive and negative electric charges abound around the developer. Further, the distribution range of the charge amount is made smaller, reverse charging of the developer is eliminated, and charging with an appropriate specific charge amount is done without necessitating delicate arrangement of the component materials of the developer, whereby development is performed stably and the image quality can be improved.

The present invention includes an electric charge supplying apparatus provided downstream along the direction of movement of the developer carrier than the developer regulating member, for applying electric charges to the developer on the developer carrier, and the developer regulating member can also serve as a charge amount control member. By this structure, it becomes possible to effectively control the charge amount of the developer, in the small space near the developer regulating member.

According to an embodiment of the developing apparatus of the present invention, the developer regulating member is formed of a rotating body and the apparatus further includes a developer removing member that is in contact with the developer regulating member and removing the developer carried by the developer regulating member, and a charge clearing means arranged upstream along the direction of rotation of the developer regulating member than the contact portion between the developer regulating member and the developer carrier and downstream along the direction of rotation of the developer regulating member than the contact portion between the developer regulating member and the developer removing member, for clearing the charges on the surface of the developer regulating member.

By this structure, in the present invention, the surface of the developer regulating member is cleaned by the developer removing member and further, the surface potential of the developer regulating member is cleared by the charge clearing means, before the step of developer charge clearing in the small space. Therefore, at the time of charge clearing with the developer flying in the small space, the charge clearing operation can be done stably.

Preferably, the developing apparatus of the present invention includes an electric charge supplying apparatus provided downstream along the direction of rotation of the developer carrier than the contact portion between the developer carrier and the developer regulating member and upstream along the direction of rotation of the developer carrier than the position at which the developer carrier and the image carrier oppose to each other, for supplying electric charges to the developer layer on the developer carrier, and the charge clearing means clears charges, using the electric charges generated by the electric charge supplying apparatus. By this structure, it becomes possible to charge the developer on the developer carrier to a prescribed potential by means of the electric charge supplying apparatus, as the electric charges generated within the electric charge supplying apparatus are used, a stable charge clearing level can be attained without the necessity of providing a new charge clearing apparatus or a power supply.

In the present invention, more preferably, the developer carrier and the developer regulating member move in opposite directions at the contact portion, and the peripheral speed of the developer regulating member is set to be faster than the peripheral speed of the developer carrier. When the peripheral speed of the developer regulating member is slower than the peripheral speed of the developer carrier, new surfaces of the developer carrier move successively to the discharging portion, while the surface that has been already exposed to the discharging portion of the developer regulating member opposes thereto, and therefore, the charge clearing property of the developing layer becomes unstable, because of the influence of the charge state of the developer regulating member. When the peripheral speed of the developer regulating member is made faster than that of the developer carrier, a new surface that has not yet been exposed to the discharge of the developer regulating member opposes to the developer layer, and hence, charge clearing property is made stable.

In the present invention, when the developer is caused to fly from the developer carrier to the small space by the AC voltage applied between the developer carrier and the developer regulating member and the developer has its charges cleared by the application of the electric charges generated from gas electrolytic dissociation caused by the AC voltage, it is preferred that the absolute value of the specific charge amount is at least 5 $\mu$C/g. This enables formation of the developer not including reverse-charged developer on the developer carrier.

In a preferred embodiment of the present invention, the developer carrier has a multi-layered structure having an elastic layer and a conductive layer formed in this order around a conductive axis of rotation, and a conductive layer electrically connecting the conductive layer and the axis of rotation is formed at an end surface.

By this structure, it becomes possible to set the surface potential of the developer carrier to approximately 0V by grounding the axis of rotation, for example, and hence, it becomes possible to stably charge the developer.

According to another aspect, in the developing apparatus of the present invention, the charge amount control member is provided downstream along the direction of movement of the developer than the layer thickness regulating member regulating the layer thickness of the developer and electrically insulated from the developer carrier. An AC voltage is applied between the developer carrier and the charge amount control member, wherein Vp/(square of f)>160 is satisfied where Vp (V) represents pulsating amplitude of the AC voltage and f represents frequency f (kHz), and wherein the AC voltage is not lower than a discharge start voltage in the space formed between the developer carrier and the charge amount control member.

In this structure, as the developer is caused to fly in the small space where electric charges generated by the gas electrolytic dissociation caused by the AC voltage exist, and the developer reciprocates in the small space where the electric charges generated by the gas electrostatic dissociation exist. As a result, it becomes possible to perform such a control in that the developer as a whole comes to have uniform charge amount, because of the positive and negative electric charges abound around the developer. Further, the distribution range of the charge amount is made smaller, reverse charging of the developer is eliminated and charging with an appropriate specific charge amount is performed without the necessity of delicate arrangement of the component materials of the developer, whereby development can be done stably and the image quality can be improved.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
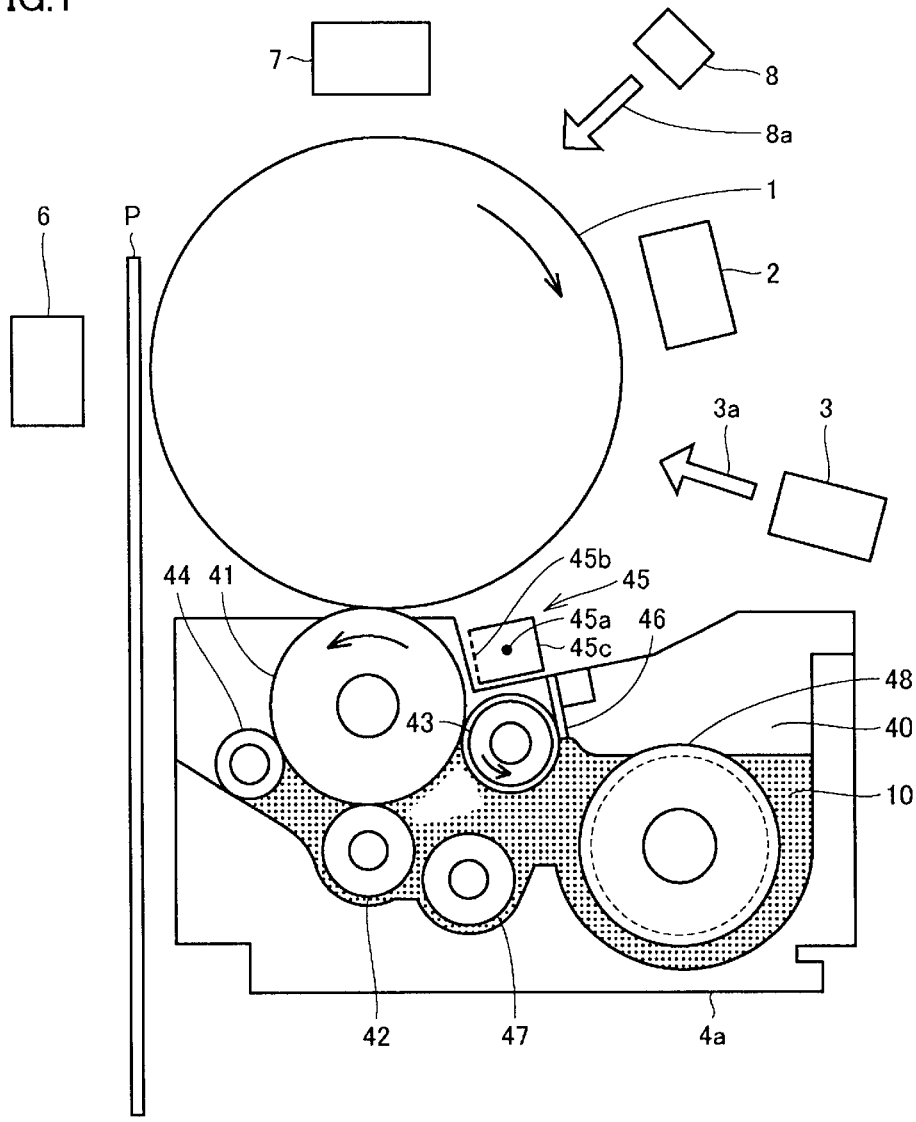
FIG. 1 is a schematic diagram showing a structure of the developing apparatus in accordance with an embodiment of the present invention and the image forming apparatus utilizing electrophotography.

The developing apparatus in accordance with an embodiment of the present invention will be described in detail in the following. FIG. 1 is a schematic diagram showing the structure of the image forming apparatus utilizing electrophotographic method and the developing apparatus in accordance with an embodiment of the present invention.

In the image forming apparatus, a photoreceptor drum 1 as an image carrier is positioned approximately at the center of the image forming portion, and opposing to and around the photoreceptor drum 1, a charging apparatus 2, an exposing apparatus 3, a developing apparatus 4*a*, a transfer apparatus 6, a cleaner 7 and an optical charge clearing lamp 8 are arranged in this order along the direction of rotation of the photoreceptor drum 1.

Photoreceptor drum 1 has an under layer applied on a metal or resin conductive base body, a carrier generating layer CGL thereon, and a carrier traveling layer CTL mainly consisting of polycarbonate as an outermost layer, applied as thin films.

At the time of image formation, photoreceptor drum 1 has its surface already charged to a desired potential by charging apparatus 2 in advance, and a latent image potential in accordance with image information is formed by exposing light beam 3*a* emitted from emission apparatus 3. Thereafter, the latent electrostatic image formed on photoreceptor drum 1 is rotated and conveyed to the developing area opposing to the developing roller 41 of developing apparatus 4*a*.

In the developing area, the developing roller 41 as the developer carrier which is in pressure-contact with the photoreceptor drum 1 has at least its surface formed of an elastic member and is conductive. Developing roller 41 supplies toner 10 as the developer which is charged to a desired value and controlled to have a desired thickness in advance to the latent electrostatic image formed on the surface of photoreceptor drum 1, so as to visualize the latent image.

After the latent image potential on photoreceptor drum 1 is visualized by toner 10, photoreceptor drum 1 rotates to a transfer area where transfer apparatus 6 is positioned. A transfer sheet of paper P fed by a paper feed apparatus, not shown, is conveyed to the transfer area and brought into contact in synchronization with the toner image on photoreceptor drum 1. To transfer apparatus 6, a voltage of such polarity that moves the toner 10 on photoreceptor drum 1 to the transfer sheet of paper P is applied, so that the toner image on photoreceptor drum 1 is moved to transfer sheet of paper P. Transfer sheet of paper P to which the toner image has been transferred is conveyed generally to a thermal fixing apparatus (not shown), so that the image is melt and fixed on the sheet, and thereafter, the sheet is discharged.

The toner that was left untransferred on the photoreceptor drum 1 after it passed through the transfer area is removed by a cleaner 7 from photoreceptor drum 1, and the potential of photoreceptor drum 1 is refreshed by charge clearing beam 8*a* emitted from optical charge clearing lamp 8 eliminating the remaining electrical charges on photoreceptor drum 1. Then, the operation returns to the first step.

Refreshment of the charge potential (electric charges) of the charged photoreceptor drum 1 is performed by a lamp light in an analog machine, and in the digital machine, the refreshment is performed as the electric charges are canceled by the carrier generated by the CGL, generally by means of a laser beam.

The developing apparatus 4*a* will be described in detail in the following. Toner 10 contained in a toner tank 40 of developing apparatus 4*a* is conveyed by a screw 48 and a conveyer roller 47 to the vicinity of developing roller 41. As to the structure of developing roller 41, developing roller 41 has an axis of rotation formed of stainless steel and having a diameter of 18 mm, a semiconductive elastic layer having volume resistivity of $10^6$ Ω·cm and the thickness of 8 mm formed on the surface of the axis, and a conductive layer having volume resistivity of $10^3$ Ω·cm and the thickness of 20 μm formed on an upper portion of the semiconductive elastic layer and on an end surface of the developing roller. Resistance value between the surface of the developing roller and the axis of rotation is 300Ω to 5 kΩ.

The base material of the semiconductive elastic layer and the conductive layer is of urethane resin, and the resistance value is adjusted by changing the amount of dispersed carbon black. Rubber hardness of the semiconductive elastic layer and the conductive layer is 65 degrees in accordance with ASKER C hardness. Contact width with the photoreceptor drum 1 is about 1.5 mm, and the roller rotates at a peripheral speed of 100 mm/s.

A toner supply roller 42 is in pressure-contact with developing roller 41. At the contact portion with the developing roller 41, toner supply roller 42 rotates in the direction opposite to the direction of rotation of developing roller 41. Toner supply roller 42 is formed of a similar material as developing roller 41 and adjustment of electrical resistance is performed by the similar resistance adjusting material as for developing roller 41. In order to increase elasticity, a foam material is used for toner supply roller 42. Further, a voltage is applied from a bias power supply, not shown, to toner supply roller 42. Generally, the bias voltage is applied in that direction which presses toner 10 toward developing roller 41. For example, if toner 10 is of negative polarity, a bias voltage larger in the negative side is applied to the toner supply roller 42.

The toner 10 supplied by toner supply roller 42 to developing roller 41 is conveyed to the position where regulating member 3 and developing roller 41 are in contact, by the rotating operation of developing roller 41.

Regulating member 43, that is the developer regulating member, has an axis of rotation formed of stainless steel having the diameter of 16 mm and an insulating layer having the thickness of 30 μm formed on the surface of the axis, and in the present embodiment, it is covered by a film of polyethylene terephthalate. Regulating member 43 is in contact with developing roller 41, and at the contact portion, rotates at a peripheral speed of 150 mm/s in a direction opposite to the direction of rotation of developing roller 41. Regulating member 43 is in contact with developing roller 41 with a prescribed pressure, and to the generating member, a prescribed bias voltage is applied. Thus, the toner carried by developing roller 41 is regulated to have a prescribed charge amount and a prescribed thickness.

Downstream along the direction of rotation than the contact portion between regulating member 43 and developing roller 41, a blade 46 formed of stainless steel having the thickness of 0.5 μm is provided to contact the outer surface of regulating member 43, which serves as the developer removing member for scraping of the toner adhering on the surface of regulating member 43. Because of this structure, the surface of regulating member 43 is always kept clean, when brought into contact with developing roller 41.

The toner layer formed on the surface of developing roller 41 by the contact between developing roller 41 and regulating member 43 is conveyed to a position opposing to electric charge supplying apparatus 45. In electric charge supplying apparatus 45, a wire electrode 45a formed of tungsten and having the diameter of about 70 μm is suspended along the direction of the axis of rotation of the developing roller 41. Further, the charging surface side is surrounded by a mesh electrode 45*b* formed of stainless steel and having an opening with the opening ratio of about 85% and remaining three sides are surrounded by a shield electrode 45*c* formed of stainless steel. At the time of charging, the electric charges generated near the wire electrode 45*a* are drawn to the direction of the surface of the toner layer by the electric field deriving from the potential of mesh electrode 45*b* and the potential of the toner layer surface, and adhere to toner 10, whereby the toner 10 is charged.

After toner 10 is supplied to the latent image on photoreceptor drum 1, the undeveloped toner on developing roller 41 that was not used in the developing step is returned to the developing apparatus 4 as developing roller 41 rotates. By the charge clearing apparatus 44 provided downstream of the developing area along the direction of rotation of developing roller 41 and upstream of toner supply roller 42, the electric charges of the undeveloped toner on developing roller 41 are removed, and as the supply roller 42 is in pressure-contact, the toner is removed and recovered to toner tank 40, to be used again.

Electric charge clearing apparatus 44 is an elastic roller member and it is formed of a metal material or a low resistance material having the resistance value of at most 10 kΩ at a portion that is in contact with developing roller 41, with the toner layer interposed therebetween. Electric charge clearing apparatus 44 may be a plate shaped elastic member. In that case, it is formed of a metal material or a low resistance material having the resistance value of at most 10 kΩ at a portion where it is in contact with developing roller 41 with the toner layer interposed therebetween.

A bias voltage Vd is supplied from a power supply circuit, not shown, to electric charge clearing apparatus 44. The bias voltage Vd may be 0V (ground), or it may be an AC voltage of about ±800V.

Toner 10 consists of fine particles having the average particle diameter of 5.5 μm, consisting of a base material of styrene-acryl copolymer, to which carbon black is added. The toner is formed to a toner layer having the average layer thickness of about 10 μm and packing density of about 50%, by means of regulating member 43.

Examples of the voltage applied to respective members when an image is formed are as follows. Developing roller 41 is set to −400V, supply roller 42 is set to −500V (=potential of developing roller −100V), a voltage of −3.7 kV is applied to wire electrode 45*a*, −500V (=potential of developing roller −100V) is applied to mesh electrode 45*b* and a bias voltage of −500V, same as mesh electrode 45*b*, is applied to shield electrode 45*c*, of the charging apparatus.

In developing apparatus 4 having the above described structure, an AC voltage having the amplitude of $1200V_{0\text{-}p}$ and the frequency of 2 kHz is applied to the axis of rotation of regulating member 43. At this time, the small gap portion, which is the small space formed downstream along the direction of rotation of developing roller 41 at the contact portion between regulating member 43 and developing roller 41, is made to be a state of plasma by discharge, and by the electric charges having positive and negative polarities thus generated, the toner layer has its charges cleared.

Figure 9A:
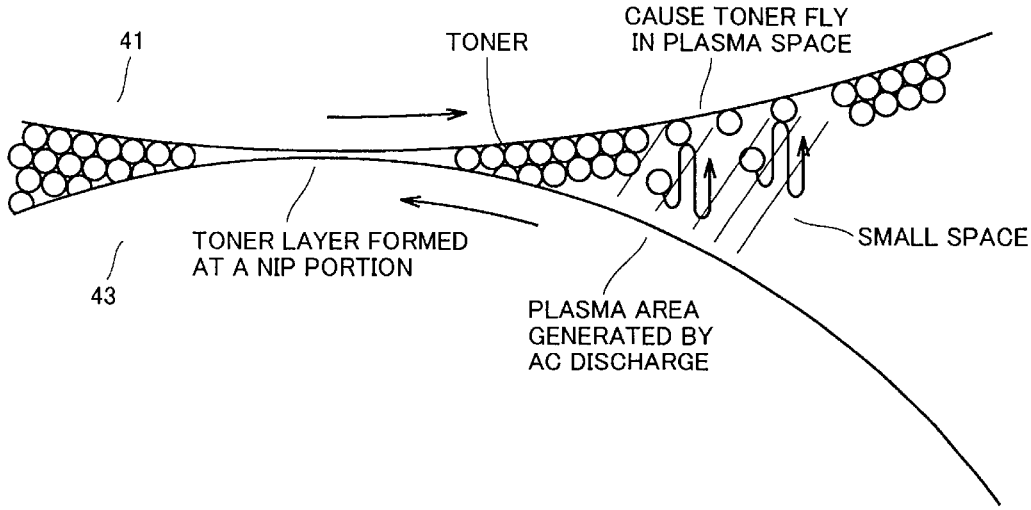
FIGS. 9A to 9C are illustrations showing the state of toner flight between the developing roller and the regulating member.
Figure 9B:
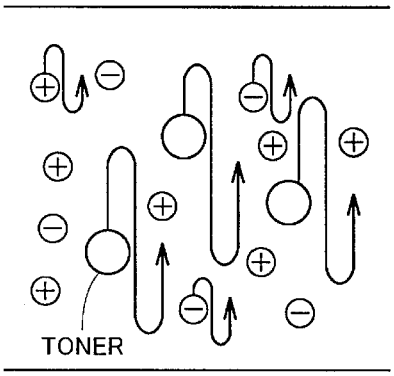

FIGS. 9A and 9B show states of flight of the toner between the developing roller and the regulating member. As can be seen from FIG. 9A, the small gap portion between developing roller 41 and regulating member 43, is made to be a state of plasma, and toner particles fly in the small gap portion. As the toner particles fly in the plasma space, positive and negative electric charges abound therearound adhere to the surfaces of toner particles as shown in FIG. 9B, and thus the overall toner surface is uniformly cleared of charges.

Figure 9C:
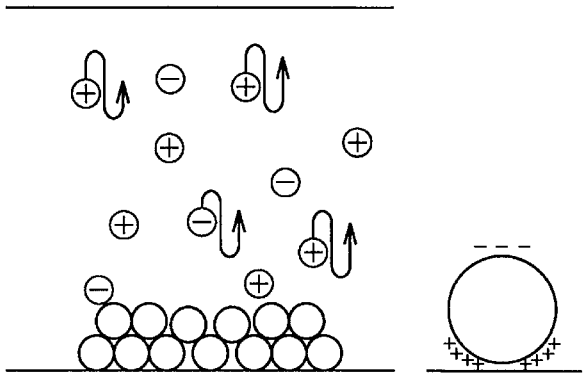
Figure 10:
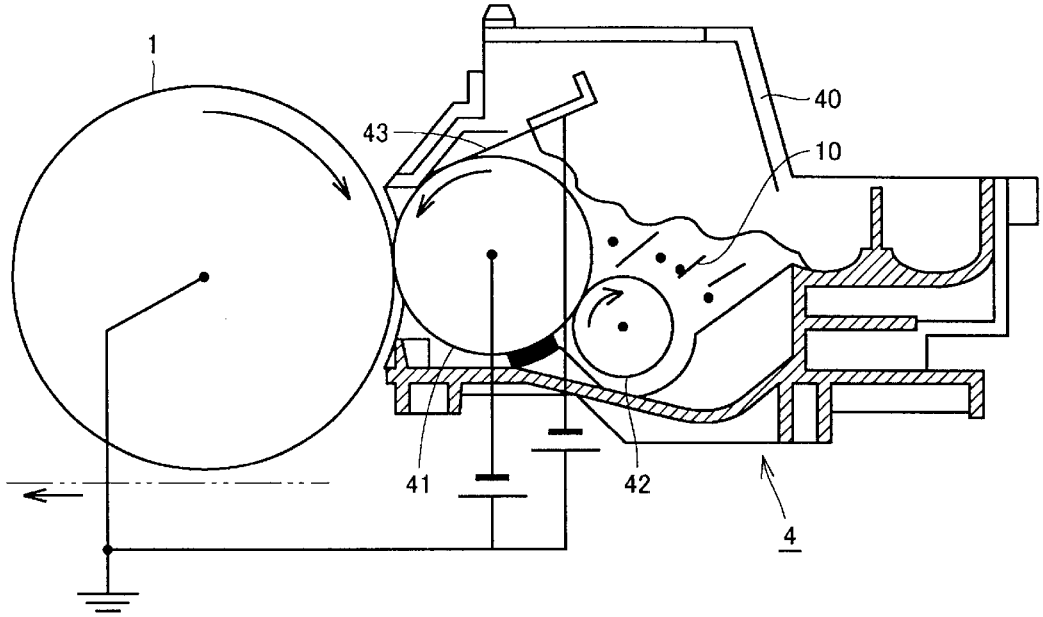
FIG.10 PRIOR ART
FIG. 10 is a schematic diagram of a developing apparatus applied to a mono component developing method using a mono component developer consisting of toner only, in the conventional electrophotographic image forming apparatus.
Figure 11:
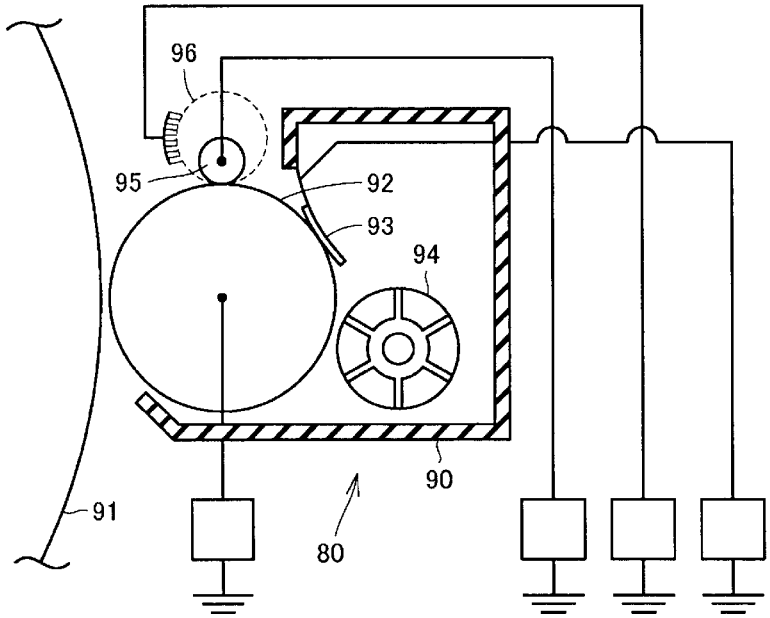
FIG.11 PRIOR ART
FIG. 11 is a schematic diagram of the developing apparatus disclosed in the first prior art example.
Figure 12:
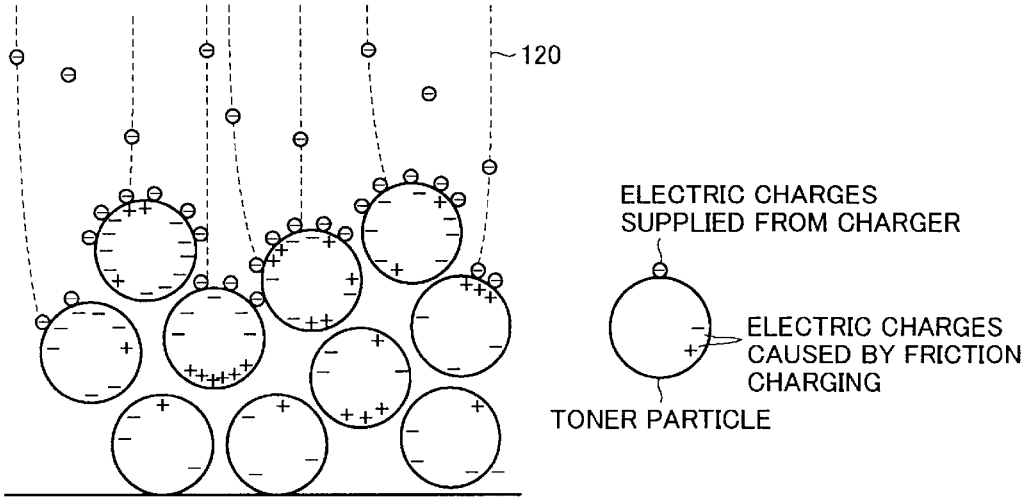
FIG. 12 is an illustration showing the image of the state of charging toner particles by the electric charge supplying apparatus.

Referring to FIG. 9C, in the prior art, the toner particles do not fly in the small gap portion. Therefore, only the surfaces or portions near the surface of the toner particles are cleared of charges, and the charge clearing operation ends when potential balance of the overall toner layer is attained.

When toner particles are caused to fly in the small gap portion which has been made to be a state of plasma as shown in FIG. 9A, the thickness of the toner layer formed on developing roller 41 becomes very uniform, and thicker than when no AC voltage is applied between developing roller 41 and regulating member 43. A reason for this may be that the toner layer, which is once caused to fly in the small space and -formed again without compacting, has smaller packing density than the toner layer compacted by the regulating member 43.

Figure 2:
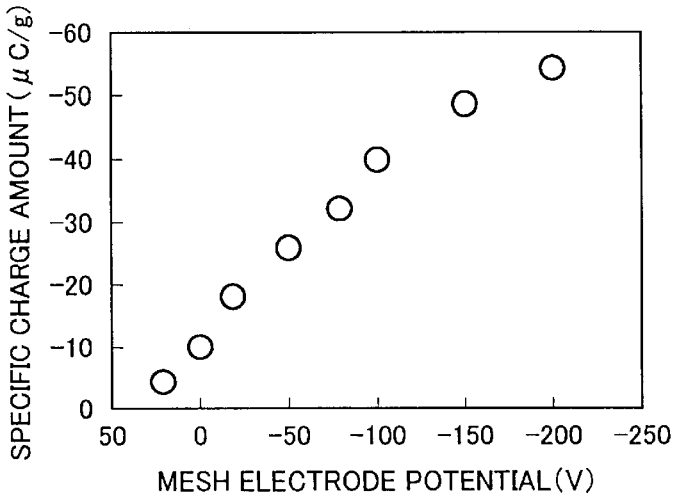
FIG. 2 shows a relation between the potential of a mesh electrode and specific charge amount of the toner.

FIG. 2 shows the relation between the potential of the mesh electrode and the specific charge amount of the toner. The specific charge amount of the toner measured at the developing position with the operation of electric charge supplying apparatus 45 stopped was about −3 $\mu$C/g. Thereafter, the specific charge amount was measured with the electric charge supplying apparatus 45 operated and the potential and mesh electrode 45*b* varied, of which result is as shown in FIG. 2. Namely, the specific charge amount can be controlled to an arbitrary value in the wide range of −4 to −54 $\mu$C/g, and particularly, it becomes possible to generate toner having small particle diameter and low specific charge amount. The horizontal axis of the graph shown in FIG. 2 expresses the potential difference between mesh electrode and developing roller 41 (potential of mesh electrode—potential of developing roller 41). The potential of developing roller 41 was set to 0V in this experiment.

In the present embodiment, developing roller 41 has low resistance. Therefore, by electrically insulating the surface of regulating member 43, it becomes possible to clear the charges by the discharge at the small gap portion, and to prevent damage to the developing roller 41 or regulating member 43 caused by excessive current at the contact portion.

For comparison, a rubber roller formed of a semiconductive material having $10^7$ Ω·cm and the thickness of 5 mm is used in place of the insulating layer and an attempt was made to cause discharge. However, the current flows to developing roller 41 and discharge did not occur. Possible reason is that, though the toner layer exists as an insulating layer at the contact portion between developing roller 41 and regulating member 43, developing roller 41 or regulating member 43 is an elastic body, and therefore these two come to be in contact partially even when there is the toner therebetween, resulting in current flow from the regulating member 43 to developing roller 41.

Thus, it is found that at least that portion of regulating member 43 which is in contact with developing roller 41 must be a high resistance layer (insulating layer) that enables discharge.

Figure 3:
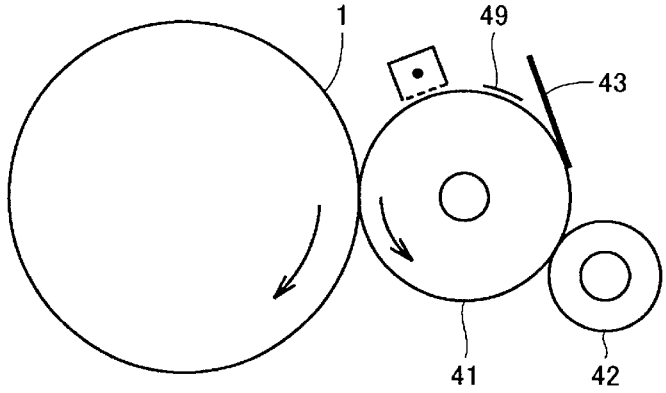
FIG. 3 is a schematic diagram of the developing apparatus of the present invention in accordance with another embodiment.

FIG. 3 is a schematic diagram showing another embodiment of the developing apparatus. In the developing apparatus shown in FIG. 1, regulating member 43 is used as one of the discharging electrode. Referring to FIG. 3, a charge clearing metal electrode 49 fixed apart by a prescribed distance from developing roller 41 may be used instead. In this case, considering the distance between metal electrode 49 and developing roller 41 that can be practically positioned, the voltage necessary for clearing charges becomes higher. However, forming of the toner layer at the regulating member 43 and clearing of charges of the toner layer by the charge clearing metal electrode 49 can be controlled independent from each other. Thus, more stable and sure control is possible.

In the image forming apparatus, in order to measure the amount of reverse-charged toner, the following experiment was conducted. A voltage was applied to the axis of rotation of regulating member 43 to clear the charges of the toner layer, and thereafter, the voltage to be applied to mesh electrode 45*b* was fixed at potential of developing roller −100V, to charge the toner. At this time, as shown in FIG. 2, the specific charge amount was about −40 $\mu$C/g. The developing bias voltage (=potential of photoreceptor drum 1−potential of developing roller 41) was set to −400V, and the amount of toner adhered to the latent image carried by photoreceptor drum 1 was measured. The potential of developing roller 41 was set to 0V in this experiment. The charge polarity of toner was negative polarity, and therefore, the toner used for development in the above-described state where the developing bias voltage was applied was the reverse-charged toner charged to the polarity opposite to the normal polarity (negative polarity). This means that the smaller the amount of toner adhesion, the smaller the amount of reverse-charged toner.

Figure 4:
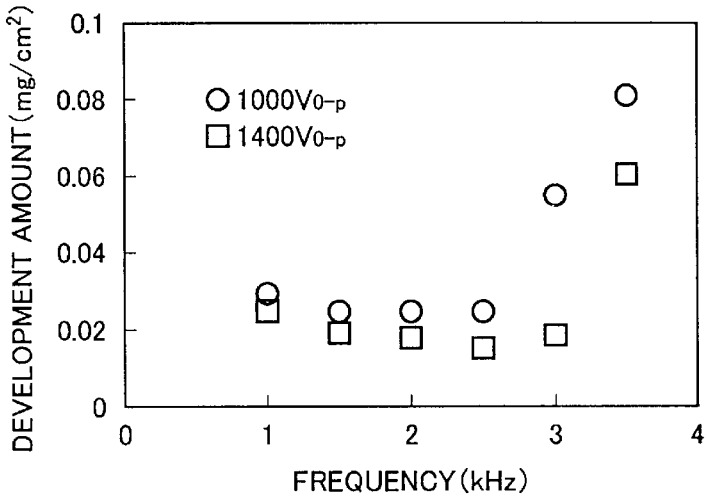
FIG. 4 shows a result of measurement of the developing amount when charge clearing conditions (frequency and voltage amplitude) are varied.

FIG. 4 shows the result of measurement of the amount of development when the conditions for charge clearing (frequency and voltage amplitude) were varied. By changing the amplitude and frequency f of the AC voltage applied to the axis of rotation of regulating member 43, the amount of reverse-charged toner changed. As can be seen from FIG. 4, as compared with the amount of reverse-charged toner when f=3 kHz or higher, which was considered satisfactory in the first prior art example, the amount was significantly reduced to ¼ (=0.02/0.08) at the frequency of f=2.5 kHz with the amplitude of the AC voltage being $100V_{0\text{-}p}$. Similarly, with the amplitude of the AC voltage being $1400V_{0\text{-}p}$, generation of the reverse-charged toner is extremely suppressed when the frequency was 3.5 kHz or lower.

The reason may be as follows. When the toner is charged simply by the electric charge supplying method, electric charges do not reach to the back side of toner when viewed from the side of the electric charge supplying apparatus as described with reference to FIG. 9C. Therefore, when there are electric charges of the opposite polarity (here, positive polarity) on the back side of the toner, such electric charges remain. In the present invention, as described with reference to FIG. 9B, the toner is caused to fly in the small gap when the toner is subjected to charge clearing, and hence, the electric charges of the opposite polarity on the back side of the toner are also cleared, and hence, the amount of reverse-charged toner is reduced.

When the amplitude of the AC voltage was $1000V_{0\text{-}p}$, the amount of reverse-charged toner increased when the frequency was f=3.0 kHz or higher. When the amplitude of the AC voltage was $1400V_{0\text{-}p}$, the amount of reverse-charged toner increased when f=3.5 kHz or higher. The reason may be that when the frequency becomes higher, the toner cannot follow the change in the electric field and fail to fly, so that the opposite polarity electric charges on the back side of the toner remain, and the amount of reverse-charged toner cannot be reduced.

Now, note the inflection point of the amount of development with respect to the frequency. The value (amplitude of AC voltage)/(square of frequency) is $1000/(2.5^2)=160$ when the amplitude was $1000V_{0\text{-}p}$, and $1400/(3.0^2)=156$ when the amplitude was $1400V_{0\text{-}p}$. Namely, it is understood that the effect can be attained when the value (amplitude of AC voltage)/(square of frequency) is about 160 or higher. The reason may be as follows. The amplitude of the toner in the electric field is in proportion to the electric field and in inverse proportion to the square of the frequency, and when the above described value is satisfied, the toner flies, while if the value is smaller than 160, the amplitude is too small so that the toner does not substantially fly. The specific charge amount immediately after the layer was formed by the regulating member 43 was about −60 μC/g. However, the result was similar when the toner of about −35 μC/g was used.

In the present embodiment, the toner is caused to fly by the function of the AC electric field. The method in which the toner is caused to fly by mechanical oscillation, attained, for example, by a piezoelectric element, may be used. This also applies to the second embodiment, and what is necessary is that, at least in the period in which charge clearing takes place, the toner is in the state of flying, including reciprocation, in the small gap between the developing roller 41 and the regulating member 43.

Second Embodiment

Figure 5:
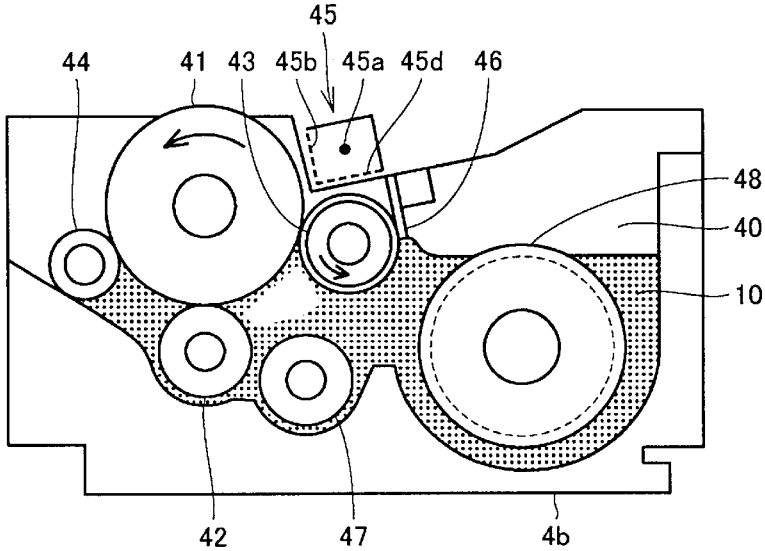
FIG. 5 is a schematic diagram of a developing apparatus in accordance with an embodiment of the present invention.

The structure of the developing apparatus in accordance with the second embodiment will be described with reference to FIG. 5. FIG. 5 is another schematic diagram of the developing apparatus in accordance with the present embodiment. Different from the developing apparatus 4*a*, in the developing apparatus 4*b*, a mesh electrode 45*d* is provided in place of shield electrode 45*c* on that side of electric charge supplying apparatus 45 which opposes to the regulating member 43, and that the voltage applied to mesh electrode 45*d* is set to 0V. Here, on the upstream side of the contact portion with developing roller 41 along the direction of rotation of regulating member 43, the surface potential of regulating member 43 is 0V.

When the regulating member having the insulating layer as a surface layer described in the first embodiment is used as an electrode for clearing charges of the toner, the toner layer on the developing roller is also regarded as the insulating layer, and therefore, there results an AC discharge between insulating surfaces. Accordingly, the point of convergence of charges generated by the discharge, that is, the amount of electric charges of the toner after charge clearing was somewhat unstable. However, by cleaning the surface of regulating member 43 by means of the blade before the step of charge clearing and by fixing the surface potential of regulating member 43 at 0V, stable charge clearing level is ensured. Further, as the electric charges generated in the electric charge supplying apparatus 45 are used, stable charge clearing level can be attained without the necessity of new charge clearing apparatus or a new power supply.

In the present embodiment, toner adjusted to be charged in the negative polarity at the time of friction charging is used. Therefore, the regulating member 43 is charged to some extent to the positive polarity. Therefore, only the negative electric charges may be supplied from electric charge supplying apparatus 45. When the regulating member 43 is charged to the negative polarity, however, because of the toner material or the surface material of regulating member 43, it becomes necessary to apply electric charges of positive polarity. Therefore, at that time, electric charges of both polarities may be generated by applying an AC voltage to the wire electrode 45*a*, for example. As another embodiment that can realize stable charge clearing level without acquiring new charge clearing apparatus or a power supply, blade 46 may simply be grounded. Because of the AC voltage applied to regulating member 43 for charge clearing, an AC discharge occurs at the small gap portion between regulating member 43 and blade 46, and as blade 46 is grounded, the insulating layer of regulating member 43 can be charge-cleared to 0V, and a stable charge clearing level is ensured.

Figure 6:
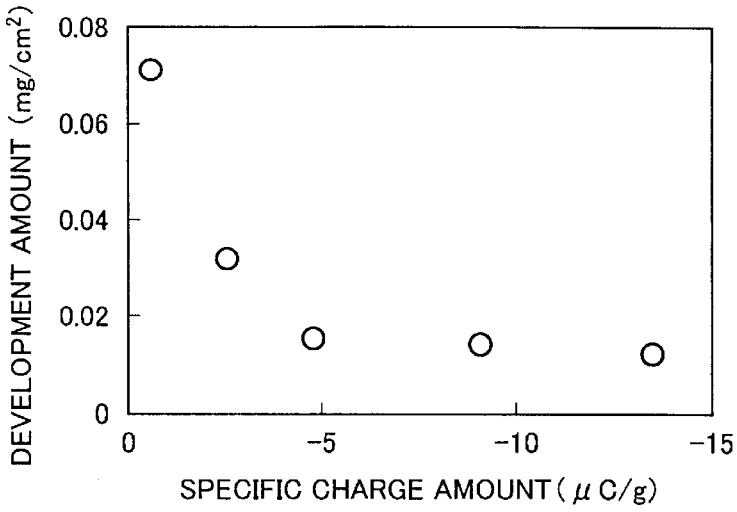
FIG. 6 shows a relation between the amount of development and specific charge amount after charge clearing.

In the developing apparatus 4*b* shown in FIG. 5, the toner layer was charge-cleared by applying the AC voltage having the amplitude of $1200V_{0\text{-}p}$ and the frequency of 2 kHz to the axis of rotation of regulating member 43, and thereafter, the potential of mesh electrode 45*b* was set to potential of developing roller 41 −100V, developing bias voltage (=potential of photoreceptor drum 1−potential of developing roller 41) to −400V and mesh electrode 45*d* to the range of 0 to −30V, so that the surface potential of regulating member 43 was set to 0 to −30V, and the amount of adhered amount of the developer developed on photoreceptor drum 1 was measured. The potential of developing roller 41 was set to 0V in this experiment. The result is as shown in FIG. 6. FIG. 6 shows the relation between the amount of development and the specific charge amount after charge clearing. When the average specific charge amount of the charge-cleared toner layer attains about −5 μC/g or lower, the reverse-charged toner was small.

When the voltage of mesh electrode 45*d* is changed to 0 to −30V, the specific charge amount of the toner layer before charging by the electric charge supplying apparatus 45 was about −0.5 to −14 μC/g, and the toner layer charge-cleared with the voltage of mesh electrode 45*d* set to 0V has an average value of specific charge amount of 0.5 μC/g. There is a distribution in the charge amount, however, and there are some toner particles that have positive polarity. Therefore, by shifting the charge clearing level to the negative polarity side, the distribution of the charge amount is shifted, and hence, the overall distribution of the charge amount can be placed within the negative polarity side. Namely, when the voltage of mesh electrode 45*d* is set to −10V, the average value of the specific charge amount attains to about −5 μC/g or lower, and the overall distribution of the charge amount is on the negative polarity side. Thus, it can be considered that the toner layer without reverse-charged toner is formed.

Figure 7:
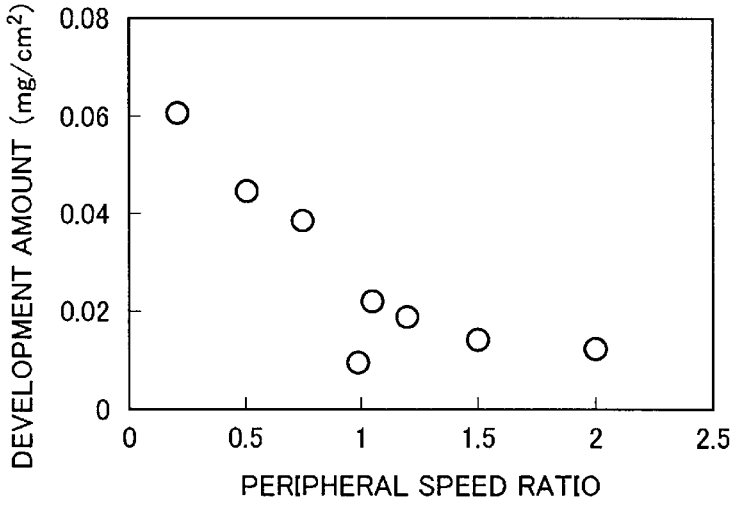
FIG. 7 shows a relation between the amount of development and the peripheral speed ratio of the regulating member.

When a toner of positive polarity is used, the result was that shown in FIG. 6, with the sign of the specific charge amount changed to positive. Namely, when the voltage of mesh electrode 45*d* is changed to 0 to 30V, the specific charge amount of the toner layer before charging by the electric charge supplying apparatus 45 was about 0.5 to 14 $\mu$C/g, and when the voltage of mesh electrode 45*d* was set to 10V or higher, the specific charge amount attains to 5 $\mu$C/g or higher, and the amount of reverse-charged toner was small. Thus, it is found that the charge amount of toner can be controlled by applying a bias voltage to regulating member 43. Accordingly, in case that it is important to minimize the volume and cost of the developing apparatus, it is possible to form satisfactory toner layer without utilizing a charge supplying apparatus, Thereafter, in the developing apparatus 4*b* shown in FIG. 5, an AC voltage having the amplitude of $1200V_{0\text{-}p}$ and the frequency of 2 kHz was applied to the axis of rotation of regulating member 43 to clear the charges of the toner layer, the voltage applied to mesh electrode 45*b* was set to potential of developing roller 41 −100V, the voltage applied to mesh electrode 45*d* was fixed at 0V, and the developer was charged. At this time, the developing bias voltage (=potential of photoreceptor drum 1−potential of developing roller 41) was set to −400V, and the peripheral speed ratio of regulating member 43 with respect to the developing roller 41 was changed in the range of 0.2 to 2.0, and the amount of adhered developer used for developing the latent image on photoreceptor drum 1 was measured. The potential of developing roller 41 was set to 0V in this experiment. FIG. 7 shows the relation between the developing amount and the peripheral speed ratio of the regulating member.

The result is that when the peripheral speed ratio was 1 or more, and preferably 1.2 or more, the amount of development was small, as shown in FIG. 7. The reason is as follows. When the peripheral speed ratio is small, to the new toner layer on the developing roller 41 successively entering the discharging portion, that portion of regulating member 43 which has already been exposed to the discharging portion opposes. Therefore, the charge clearing property of the toner layer becomes unstable, as it is influenced by the charge state of the insulating layer of regulating member 43, and because of the bias effect resulting from the potential of insulating layer of regulating member 43, charge clearing of the toner layer is shifted to some extent to the reverse charging direction, and hence the amount of development increases by the reverse-charged toner that have not been cleared. When the peripheral speed ratio is increased and the regulating member 43 is moved faster than developing roller 41, a new surface of regulating member 43 oppose to the toner layer on developing roller 41, and hence desired charge clearing can be performed stably. Thus, the amount of development reduces, that is, a toner layer with small amount of reverse-charged toner, can be formed.

In the developing apparatus 4*a* shown in FIG. 1, the specific charge amount of the toner layer on developing roller 41 was measured at the contact position with the photoreceptor drum 1, which was about −40 $\mu$C/g and very stable. When similar measurement was performed for the developing roller not having the conductive layer on its surface, the specific charge amount was −20 to −27 $\mu$C/g, which was smaller than that of the roller having the conductive layer, and there was much variation.

Figure 8:
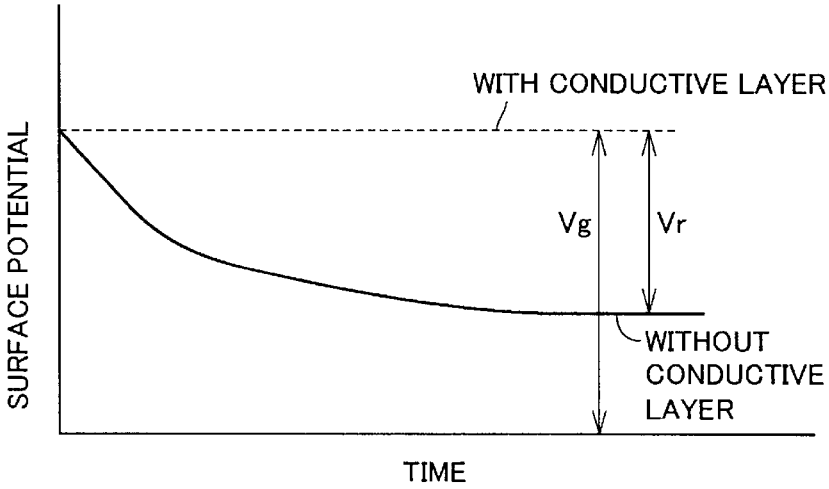
FIG. 8 shows time change of the potential of the developing roller.

To make clear this difference, the potential of developing roller 41 was measured at a contact position between developing roller 41 and photoreceptor drum 1, by a surface potentiometer, while rotation of developing roller 41 was stopped, and the result is as shown in FIG. 8. FIG. 8 shows time change of the potential of the developing roller.

The roller surface potential of the roller having a conductive layer exhibited such a characteristic as represented by the dotted line in FIG. 8, namely, the grid potential Vg approximately the same as mesh electrode 45*b* is maintained. By contrast, the surface potential of the roller not having the conductive layer has such a characteristic that lowers as time passes, as represented by the solid line in FIG. 8.

The reason for this is as follows. The developing roller 41 not having a conductive layer has, as a roller, a large resistance value or a large electrostatic capacitance. Therefore, it takes long time from the charges introduced from the surface of the roller to go out to the axis of rotation. Therefore, at the time of charging of the toner layer, developing roller 41 has some potential Vr ($\neq$0) before charging, because of the current introduced from toner supply roller 42 or the like, and the surface potential of the toner layer is charged until it reaches the grid potential Vg, including the roller potential Vr, and the electric charges in developing roller 41 continuously go out to the axis of rotation. Therefore, after charging, the surface potential reduces, and when all the electric charges in developing roller 41 are exhausted, the surface potential reaches the bottom at Vg−Vr. Thus, the actual potential resulting from the toner electric charges is about Vg−Vr.

As described above, it was found that the charging in accordance with the charge supplying method is considerably influenced by the potential on the back surface portion of the toner layer. Here, even when there is the influence of potential on the back surface, charging of the toner layer does not suffer from any problem if the potential is constant. However, if the difference between the attenuation time constant and the time from introduction of the electric charges to the charging completion is small as in the case of the roller used in the experiment, it was difficult to make constant the potential (difference between the introduced amount and outlet amount of electric charges). Stability is ensured when the attenuation time constant is made sufficiently large. In that case, however, not only the bias voltage but also the potential of developing roller 41 comes to have influence at the time of development, making it necessary to clear of the charges for that potential. In order to solve this problem, it is found that at least at the time of charging, developing roller 41 must be free of any potential caused by inflow of charges.

When a metal sleeve of aluminum or the like is used, for example, as developing roller 41, the above-described condition can be satisfied. However, it is preferred for the quality of the image formed on photoreceptor drum, that developing roller 41 is of an elastic body. In order to form an elastic body with low resistance, generally, it is a preferred practice to introduce carbon black, considering uniform resistance and stability. A developing roller 41 containing a large amount of carbon block in order to reduce the resistance value to that level which satisfies the above described condition becomes fragile, and as there is considerable burden imposed from the environment, the surface of the roller wears easily.

In order to solve the above described problem, through further study, it was found that by providing an elastic layer on the axis of rotation of developing roller 41, forming the surface and end surfaces of developing roller 41 by a conductive layer, and connecting the surface conductive layer and the axis of rotation through the end surface, as in the developing apparatus in accordance with the embodiment of the present invention, it is possible to set the developing roller potential to Vr≈0 at the time of charging.

Thus, the above-described problem is solved and stable charging becomes possible.

In the present embodiment, the conductive layer is provided by the dipping method. By this method, it is possible to provide layers on the surface and on the end surfaces at one time.

As to the method of connecting the surface layer and the axis of rotation, it is not limited to the dipping method. Conduction may be attained by using a conductive material same as or different from the conductive surface layer.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A developing apparatus supplying a developer to an image carrier, comprising:

a developer carrier carrying a developer on its surface; a developer regulating member regulating a layer thickness of said developer; a charge amount control member controlling a charge amount of said developer; and an electric charge supplying apparatus provided downstream along a direction of movement of said developer carrier relative to said charge amount control member, for applying electric charges to the developer on the developer carrier, wherein (i) said charge amount control member is provided downstream along a direction of movement of said developer carrier relative to said developer regulating member, (ii) said charge amount control member is electrically insulated from said developer carrier, (iii) said charge amount control member and said developer carrier define a small gap containing a plasma state atmosphere, (iv) said charge amount control member controls an amount of charge of said developer by applying an AC voltage between said developer carrier and said charge amount control member in said small gap portion so as to maintain said plasma state atmosphere and to cause said developer to fly above said developer carrier in said small gap, and (v) the developer on said developer carrier is supplied with a prescribed amount of charges by said electric charge supplying apparatus after the charge amount of the developer has been controlled by providing the developer with charges generated by said AC voltage in said small gap.

2. The developing apparatus according to claim 1, wherein said developer regulating member consists of a rotating body, and said developing apparatus further comprises:

a developer removing member in contact with said developer regulating member for removing developer carried by said developer regulating member; and charge clearing means provided upstream along the direction of rotation of said developer regulating member relative to a contact portion between said developer regulating member and said developer carrier and downstream along the direction of rotation of said developer regulating member relative to a contact portion between said developer regulating member and said developer removing member, for charge-clearing a surface of said developer regulating member.

3. The developing apparatus according to claim 2, wherein said electric charge supplying apparatus is provided downstream along the direction of rotation of said developer carrier relative to the contact portion between said developer carrier and said developer regulating member and upstream along the direction of rotation of said developer carrier relative to a portion where said developer carrier and an image carrier oppose to each other, for applying electric charges to the developer layer on said developer carrier; and wherein said charge clearing means clears charges using electric charges generated by said electric charge supplying apparatus.

4. The developing apparatus according to claim 2, wherein said developer carrier and said developer regulating member move in opposite directions at the contact portion therebetween, and a peripheral speed of movement of said developer regulating member is faster than a peripheral speed of movement of said developer carrier.

5. The developing apparatus according to claim 1, wherein adjacently downstream of said charge amount control member, an absolute value of specific charge of said developer is at least 5 $\mu$C/g.

6. The developing apparatus according to claim 1, wherein said developer carrier is a multi-layered structure body having an elastic layer and a conductive layer formed in this order around a conductive axis of rotation, and a conductive layer electrically connecting said conductive layer and said axis of rotation is formed on an end surface.

7. A developing apparatus supplying a developer to an image carrier according to claim 1, wherein, an AC voltage is applied between said developer carrier and said charge amount control member, satisfying the relation $V_p/160$ where $V_p$(V) represents pulsating amplitude of the AC voltage and f(kHz) represents frequency, and said AC voltage is not lower than a discharge start voltage in a space formed between said developer carrier and said charge amount control member.

8. The developing apparatus according to claim 7, wherein said developer regulating member consists of a rotating member, and said developing apparatus further comprises:

a developer removing member in contact with said developer regulating member for removing developer carried by said developer regulating member; and charge clearing means provided upstream along a direction of rotation of said developer regulating member relative to a contact portion between said developer regulating member and said developer carrier and downstream along the direction of rotation of said developer regulating member relative to a contact portion between said developer regulating member and said developer removing member, for charge-clearing a surface of said developer regulating member.

9. The developing apparatus according to claim 8, wherein said electric charge supplying apparatus is provided downstream along the direction of rotation of said developer carrier relative to the contact portion between said developer carrier and said developer regulating member and upstream along the direction of rotation of said developer carrier relative to a position where said developer carrier and an image carrier oppose to each other, for applying electric charges to the developer layer on said developer carrier; and wherein said charge clearing means clears charges using electric charges generated by said electric charge supplying apparatus.

10. The developing apparatus according to claim 8, wherein said developer carrier and said developer regulating member move in opposite directions at the contact portion therebetween, and a peripheral speed of movement of said developer regulating member is faster than a peripheral speed of movement of said developer carrier.

11. The developing apparatus according to claim 7, wherein adjacently downstream of said charge amount control member, an absolute value of specific charge of said developer is at least 5 $\mu$C/g.

12. The developing apparatus according to claim 7, wherein said developer carrier is a multi-layered structure body having an elastic layer and a conductive layer formed in this order around a conductive axis of rotation, and a conductive layer electrically connecting said conductive layer and said axis of rotation is formed on an end surface.

* * * * *